US006846197B2

(12) United States Patent
Hirokawa et al.

(10) Patent No.: US 6,846,197 B2
(45) Date of Patent: Jan. 25, 2005

(54) MODULAR PLUG

(75) Inventors: Kenichi Hirokawa, Shinagawa-Ku (JP); Hiroshi Ishikawa, Chiyoda-Ku (JP); Shinjiro Fujiwara, Chiyoda-Ku (JP)

(73) Assignees: Hirose Electric Co., Ltd., Tokyo (JP); Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 10/464,040

(22) Filed: Jun. 18, 2003

(65) Prior Publication Data

US 2004/0002252 A1 Jan. 1, 2004

(30) Foreign Application Priority Data

Jun. 26, 2002 (JP) ..... 2002-185921

(51) Int. Cl.[7] ..... H01R 2/24
(52) U.S. Cl. ..... 439/418; 439/941
(58) Field of Search ..... 439/417, 418, 439/941, 676

(56) References Cited

U.S. PATENT DOCUMENTS

2002/0048990 A1 4/2002 Marowsky et al.

FOREIGN PATENT DOCUMENTS

| | | |
|---|---|---|
| DE | 199 59 823 A1 | 6/2001 |
| EP | 0 840 406 A2 | 5/1998 |
| JP | 10-134903 | 5/1998 |

*Primary Examiner*—Tho D. Ta
*Assistant Examiner*—Larisa Tsukerman
(74) *Attorney, Agent, or Firm*—Cohen, Pontani, Lieberman & Pavane

(57) ABSTRACT

A modular plug which is fitted in a modular jack so as to connect twisted pair wires is provided. The modular plug comprises a housing, a guide plate which is fitted in the housing so as to separate the twisted pair wires from one another, and terminals and which are connected to electric wires untwisted from the tips of the twisted pair wires, wherein the separated twisted pair wires are held between the internal surfaces of the housing and the guide plate, thereby reducing near end crosstalk and keeping an attenuation thereof within a predetermined range.

15 Claims, 10 Drawing Sheets

MODULAR PLUG

BACKGROUND OF THE INVENTION (i) Field of the Invention

The present invention relates to a modular plug to be fitted into a modular jack, particularly to a modular plug for connecting twisted pair wires each of which is formed by twisting two electric wires.

(ii) Description of the Related Art

In general, as connector members used in a telephone system and a LAN (Local Area Network), a modular jack and a modular plug are known. The modular plug is a member which is fitted into the modular jack so as to connect a plurality of electric wires such as cables. An example of conventional modular plugs is disclosed in Japanese Patent Application Laid-Open No. 134903/1998.

As shown in FIGS. 16 and 17, a modular plug 1 generally comprises a housing 2, an alignment member 3 which is fitted into the housing 2, a guide plate 4 which is fitted to the base end side of the alignment member 3 of the housing 2, terminals 8 and 9 which are connected to eight electric wires 7*a*, 7*b*, 7*c*, 7*d*, 7*e*, 7*f*, 7*g* and 7*h* untwisted from four pairs of twisted pair wires 6A, 6B, 6C and 6D of a cable 5, and an insulation case 10.

The housing 2 comprises a shield plate 11 and an insulation portion 12 which is provided on the front end side of the shield plate 11. The insulation portion 12 has eight slits 13 at the front end. Further, the shield plate 11 has a clamp portion 14 extending to the base end side. The alignment member 3 has a horse-shaped cross section. The alignment member 3 also has eight through holes 15*a*, 15*b*, 15*c*, 15*d*, 15*e*, 15*f*, 15*g* and 15*h* corresponding to the electric wires 7*a*, 7*b*, 7*c*, 7*d*, 7*e*, 7*f*, 7*g* and 7*h*, respectively. The through holes 15 are formed alternately at an upper level and a lower level such that a through hole 15 and its adjacent through hole(s) 15 are at the different levels. Further, the guide plate 4 has four through holes 16A, 16B, 16C and 16D corresponding to the twisted pair wires 6A, 6B, 6C and 6D, respectively. The through holes 16 have a larger diameter than the through holes 15. The through holes 16 are formed alternately at an upper level and a lower level such that a through hole 16 and its adjacent through hole(s) 16 are at the different levels.

To assemble the modular plug 1 which has such a constitution, firstly, the cable 5 is passed through the insulation case 10 from the base end side, the four pairs of twisted pair wires 6A, 6B, 6C and 6D are then passed through the through holes 16A, 16B, 16C and 16D, respectively, and the eight electric wires 7*a*, 7*b*, 7*c*, 7*d*, 7*e*, 7*f*, 7*g* and 7*h* are then passed through the through holes 15*a*, 15*b*, 15*c*, 15*d*, 15*e*, 15*f*, 15*g* and 15*h*, respectively. Thereby, the four pairs of twisted pair wires 6A, 6B, 6C and 6D are held in the guide plate 4 separately from one another, and the eight electric wires 7*a*, 7*b*, 7*c*, 7*d*, 7*e*, 7*f*, 7*g* and 7*h* are held in alignment in the alignment member 3. Then, the alignment member 3 holding the electric wires 7 and the guide plate 4 holding the twisted pair wires 6 are fitted into the housing 2, and then the cable 5 is clamped therearound by the clamp portion 14. Then, the terminals 8 and 9 are inserted into the slits 13 from the outside of the housing 2 and connected to the eight electric wires 7*a*, 7*b*, 7*c*, 7*d*, 7*e*, 7*f*, 7*g* and 7*h*.

In general, modular plugs are demanded to have so-called crosstalk reduced so as to prevent the occurrence of problems such as noises. In recent years, in particular, requirements for the attenuation of near end crosstalk (NEXT) have been becoming increasingly stringent. However, the above conventional modular plug 1 has a possibility that it may fail to meet the recent stringent requirements for the attenuation of the near end crosstalk.

Under the circumstances, the present invention intends to provide a modular plug which can meet such stringent requirements for the attenuation of the near end crosstalk.

SUMMARY OF THE INVENTION

It is a primary object of the present invention to provide a modular plug which is fitted in a modular jack so as to connect twisted pair wires.

It is another object of the present invention to provide a modular plug which is fitted in a modular jack so as to connect twisted pair wires, the plug comprising: a housing, a guide plate which is fitted in the housing so as to separate the twisted pair wires from one another, and terminals which are connected to electric wires untwisted from the tips of the twisted pair wires, wherein the separated twisted pair wires are held between the internal surfaces of the housing and the guide plate.

It is a further object of the present invention to provide a modular plug which is fitted in a modular jack so as to connect twisted pair wires, the plug comprising: a housing, an alignment member which is fitted in the housing and has a through hole for holding in alignment eight electric wires untwisted from the tips of first to fourth twisted pair wires at multiple upper and lower levels, and eight terminals which are connected to the electric wires untwisted from the tips of the twisted pair wires, wherein the through hole is formed such that the inner electric wire of the first twisted pair wire and the adjacent electric wires of the second twisted pair wire are placed at different levels, the electric wires of the third twisted pair wire and the adjacent inner electric wire of the fourth twisted pair wire are placed at different levels, and the electric wires of the second and third twisted pair wires are placed side by side at the same level.

It is a still further object of the present invention to provide a modular plug which is fitted in a modular jack so as to connect twisted pair wires, the plug comprising: a housing, an alignment member which is fitted in the housing and has a through hole for holding in alignment eight electric wires untwisted from the tips of first to fourth twisted pair wires at multiple upper and lower levels, a guide plate which is fitted to the base end side of the alignment member in the housing so as to separate the four twisted pair wires from one another, and eight terminals which are connected to the eight electric wires untwisted from the tips of the twisted pair wires, wherein the through hole is formed such that the inner electric wire of the first twisted pair wire and the adjacent electric wires of the second twisted pair wire are placed at different levels, the electric wires of the third twisted pair wire and the adjacent inner electric wire of the fourth twisted pair wire are placed at different levels, and the electric wires of the second and third twisted pair wires are placed side by side at the same level, and the four twisted pair wires are held between the internal surfaces of the housing and the guide plate.

According to one embodiment of the present invention, the guide plate has a groove formed on top, bottom, left and right surfaces, and the grooves are separated from one another by partitions.

According to another embodiment of the present invention, the partitions are formed such that they expand the twisted pair wires toward the internal surfaces of the housing.

According to another embodiment of the present invention, the partitions are formed such that they expand the twisted pair wires toward the internal surfaces of the housing by front end side edges thereof.

According to another embodiment of the present invention, on the base end side of the through hole, a widened portion capable of holding the twisted pair wires to a point very close to the through hole without untwisting the twisted pair wires is formed.

It is a still further object of the present invention to provide a modular plug which is fitted in a modular jack so as to connect twisted pair wires, the plug comprising: a housing, a guide plate which is fitted in the housing so as to separate the twisted pair wires from one another, and terminals which are connected to electric wires untwisted from the tips of the twisted pair wires, wherein the twisted pair wires are held between the internal surfaces of the housing and the guide plate, the guide plate has grooves separated from one another by partitions, and the partitions have edges so formed as to expand the twisted pair wires toward the internal surfaces of the housing.

Figure 1:
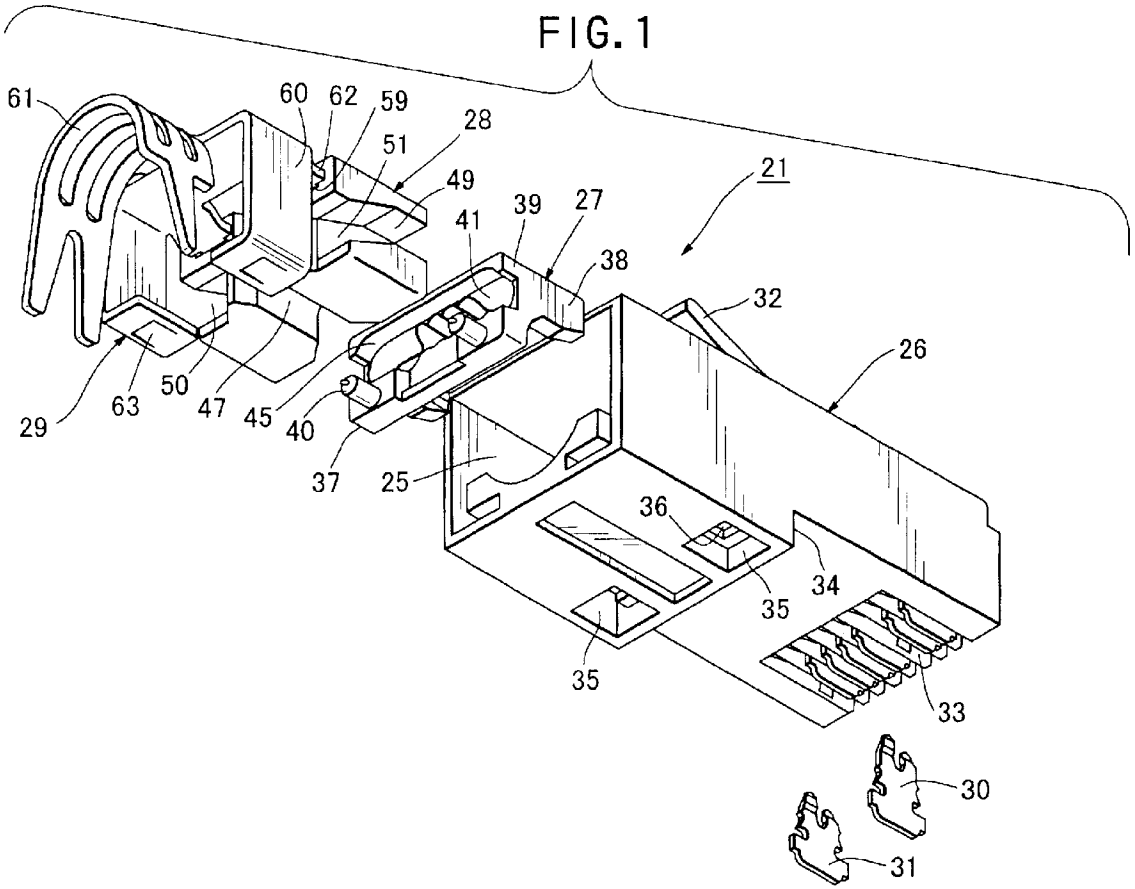
FIG. 1 is an oblique perspective view of a modular plug according to an embodiment of the present invention.
Figure 2:
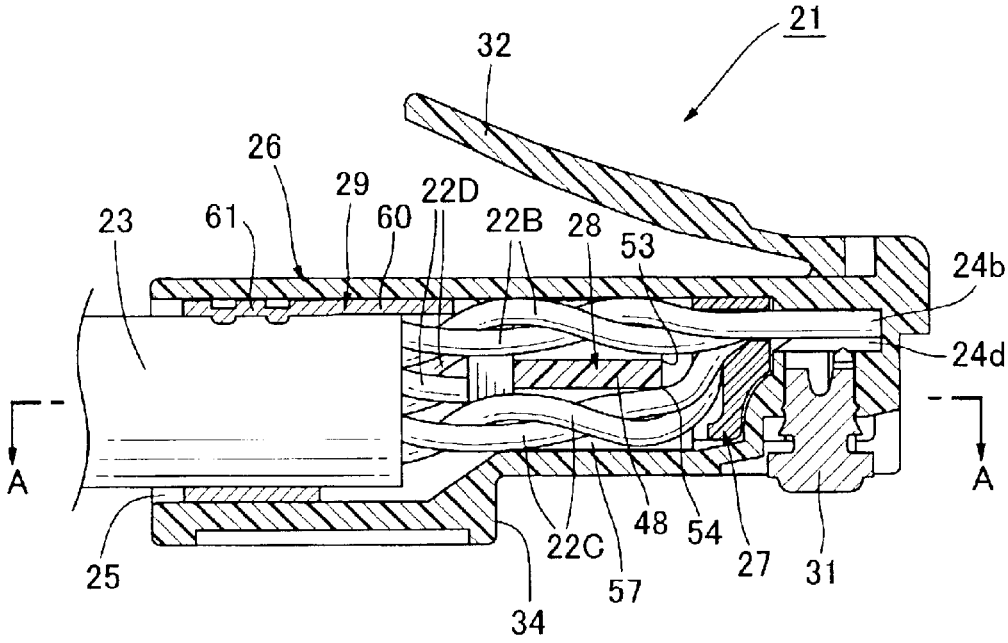
FIG. 2 is a cross-sectional view of the embodiment of the present invention.
Figure 3:
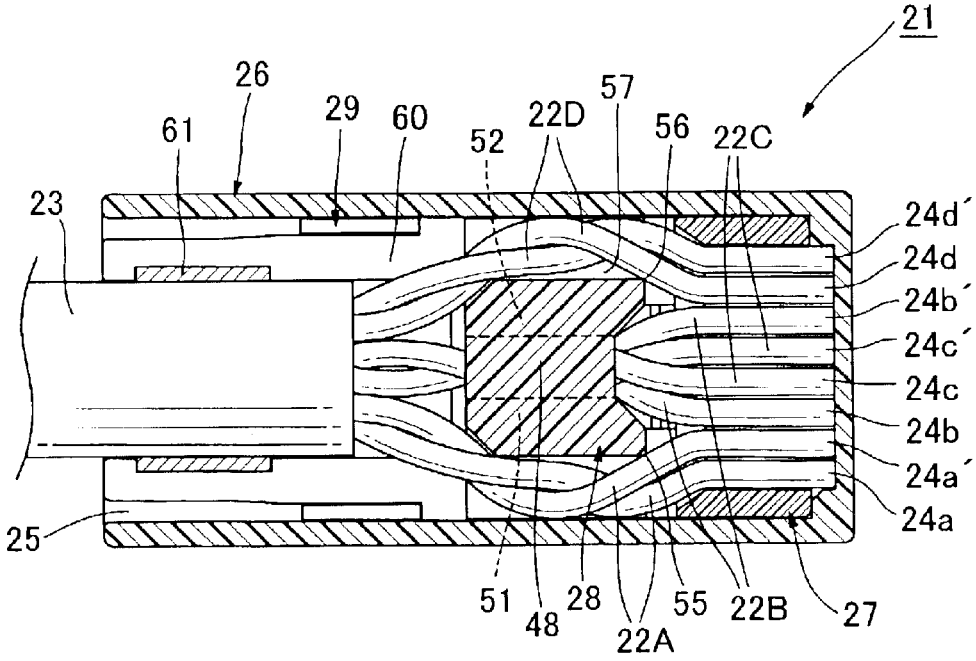
FIG. 3 is a cross-sectional view at A—A in FIG. 2.

Reference numeral 21 denotes a modular plug; 22 denotes twisted pair wires; 24 denotes electric wires; 26 denotes an insulation housing; 27 denotes an alignment member; 28 denotes a guide plate; 30 denotes terminals; 31 denotes terminals; 41 denotes a through hole; 45 denotes a widened portion; 48 denotes a horizontal partition; 51 denotes a right vertical partition; 52 denotes a left vertical partition; and 57 denotes space.

DETAILED DESCRIPTION OF THE PREFERRED EMBODIMENTS

Hereinafter, an embodiment of the present invention will be described with reference to the drawings.

FIGS. 1 to 15 show an example of a modular plug according to the embodiment of the present invention. In this example, a modular plug 21 is used for connecting electric wires 24*a*, 24*a*', 24*b*, 24*b*', 24*c*, 24*c*', 24*d* and 24*d*' of a cable 23 which comprises four pairs of twisted pair wires 22A, 22B, 22C and 22D.

The modular plug 21 generally comprises an insulation housing 26 having a fitting concave portion 25 formed on the base end side, an alignment member 27, a guide plate 28 and a clamp 29 which are inserted in the fitting concave portion 25, and two types of terminals, i.e., long terminals 30 and short terminals 31, which are connected to the eight electric wires 24*a*, 24*a*', 24*b*, 24*b*', 24*c*, 24*c*', 24*d* and 24*d*' untwisted from the four pairs of twisted pair wires 22A, 22B, 22C and 22D.

At the front end of the insulation housing 26, a lock portion 32 which extends in the direction of the base end at some angle from the top surface of the housing 26 is formed on the top surface of the housing 26, and eight parallel slits 33 are formed on the bottom surface. Further, a split-level portion 34 is formed in the middle of the bottom surface of the insulation housing 26, two concave portions 35 are formed right next to the split-level portion 34 on the base end side, and a locking projection 36 is formed in each of the concave portion 35.

Figure 4:
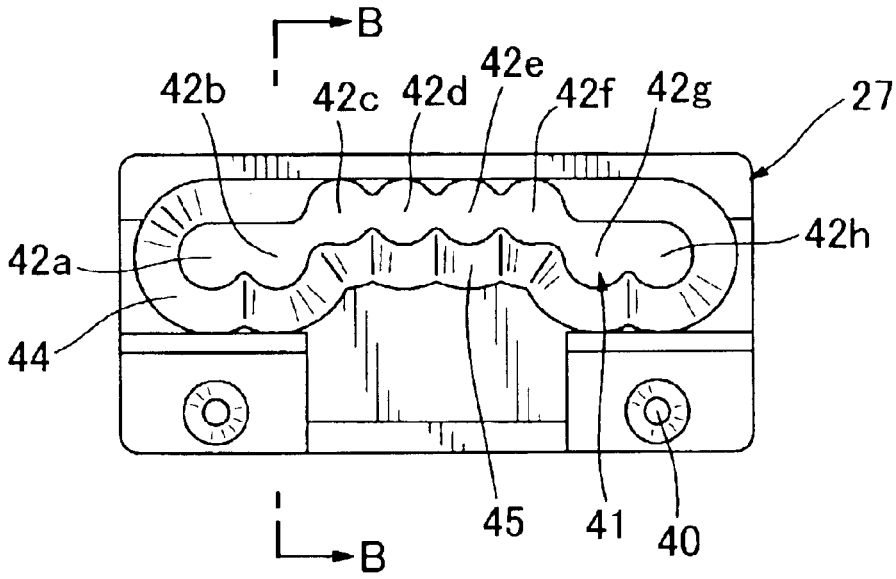
FIG. 4 is a front view of an alignment member in the embodiment of the present invention.
Figure 5:
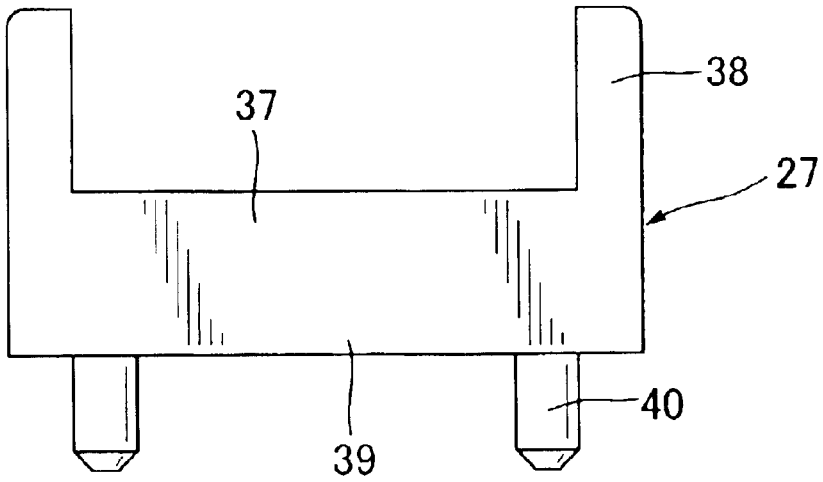
FIG. 5 is a plan view of the alignment member in the embodiment of the present invention.
Figure 6:
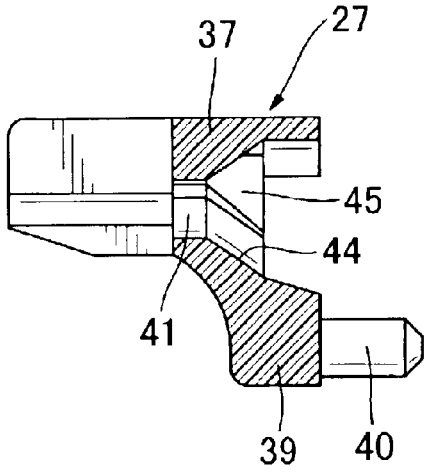
FIG. 6 is a cross-sectional view at B—B in FIG. 4.
Figure 7:
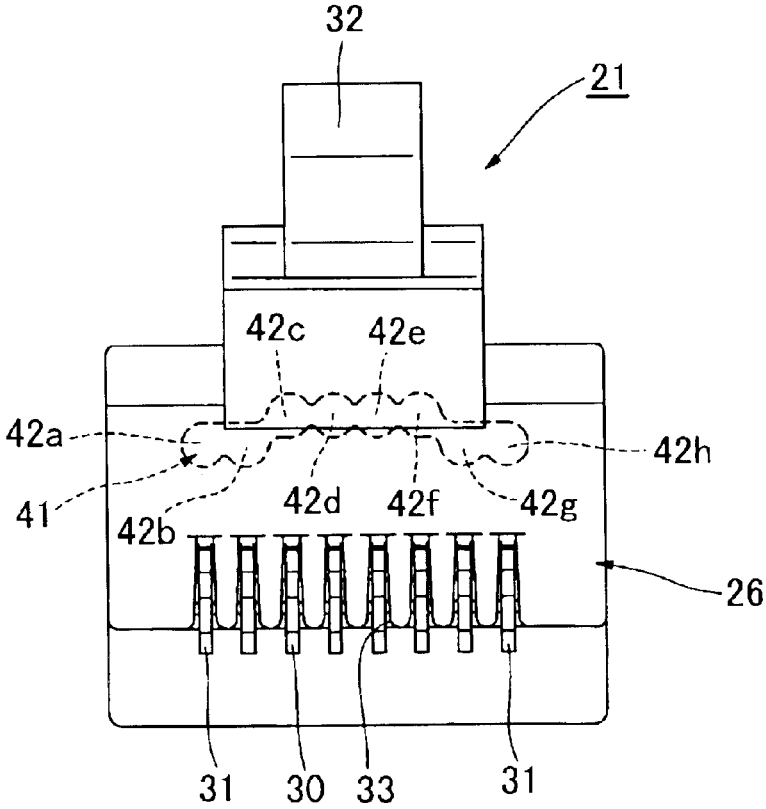
FIG. 7 is a front view of a modular plug according to the embodiment of the present invention.

FIG. 4 is a front view of the alignment member 27 viewed from the base end side, FIG. 5 is a plan view thereof, and FIG. 6 is a cross-sectional view thereof at B—B in FIG. 4. As clearly shown in FIGS. 4 to 6, the alignment member 27 comprises an electric wire holding portion 37, guide portions 38 which protrude in the direction of the front end from both sides of the electric wire holding portion 37, a twisted pair wire holding portion 39 which is formed on the base end side of the electric wire holding portion 37, and positioning projections 40 which are formed in lower portions on the base end side of both sides of the twisted pair wire holding portion 39. In the electric wire holding portion is formed a through hole 41. The through hole 41 is formed by forming eight cylindrical holes 42*a*, 42*b*, 42*c*, 42*d*, 42*e*, 42*f*, 42*g* and 42*h* in series in a horizontal direction such that each of the holes partially overlaps adjacent hole(s) thereof. In the eight cylindrical holes 42*a*, 42*b*, 42*c*, 42*d*, 42*e*, 42*f*, 42*g* and 42*h*, the eight electric wires 24*a*, 24*a*', 24*b*, 24*b*', 24*c*, 24*c*', 24*d* and 24*d*' can be inserted, respectively. Further, the cylindrical holes 42*a*, 42*b*, 42*c*, 42*d*, 42*e*, 42*f*, 42*g* and 42*h* are placed at multiple levels, e.g., at upper and lower levels. At least the adjacent holes 42*b* and 42*c* and the adjacent holes 42*e* and 42*f* are placed at different levels, and the holes 42*c*, 42*d*, 42*e* and 42*f* are placed side by side at the same level. Thus, in this example, as shown in FIG. 7, the four cylindrical holes 42*a*, 42*b*, 42*g* and 42*h* on both sides are placed at the lower level, and the four middle cylindrical holes 42*c*, 42*d*, 42*e* and 42*f* are placed at the upper level.

Further, the base end side of the through hole 41 is widened along the perimeter by an inclined plane 44, thereby forming a widened portion 45 in the twisted pair wire holding portion 39. As a result, the twisted pair wires 22A, 22B, 22C and 22D can be held in the widened portion 45 to a point very close to the through hole 41 without being untwisted, so that near end crosstalk can be reduced.

Figure 8:
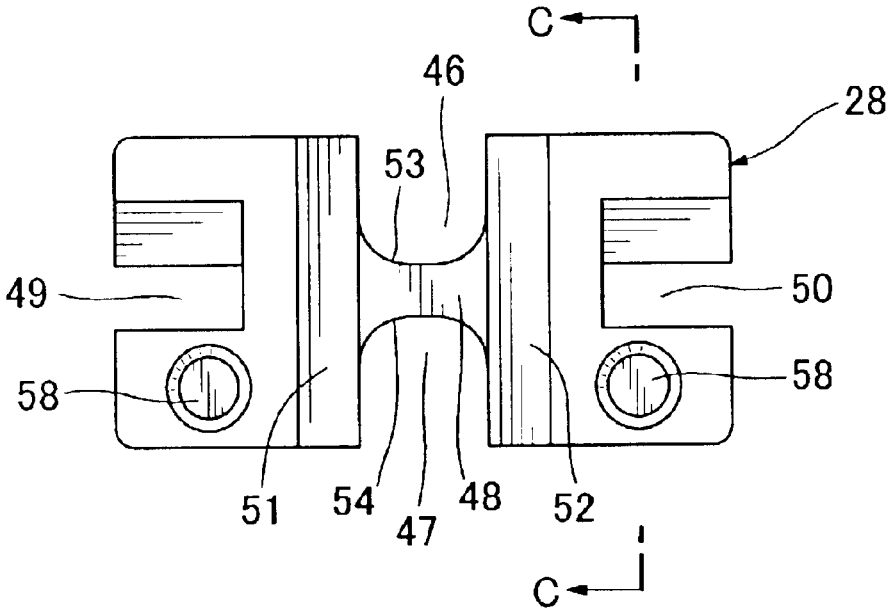
FIG. 8 is a front view of a guide plate in the embodiment of the present invention.
Figure 9:
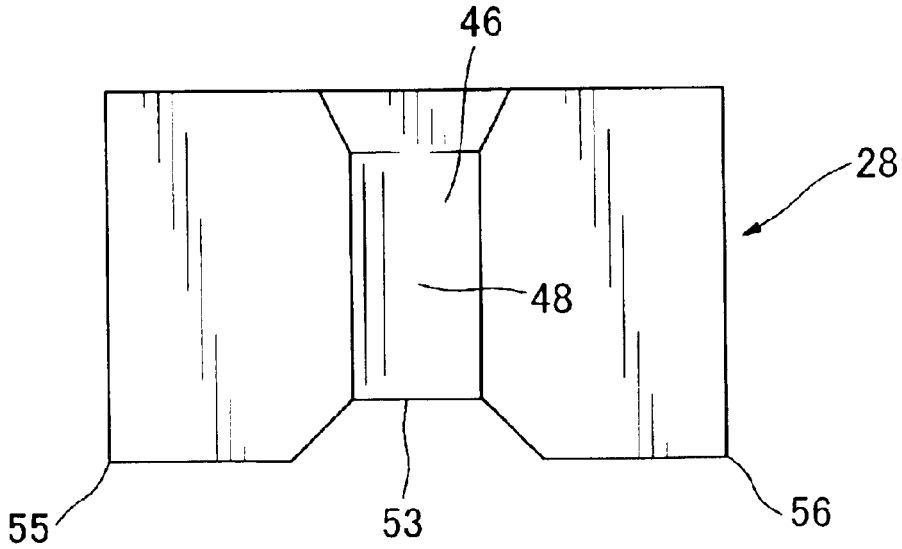
FIG. 9 is a plan view of the guide plate in the embodiment of the present invention.
Figure 10:
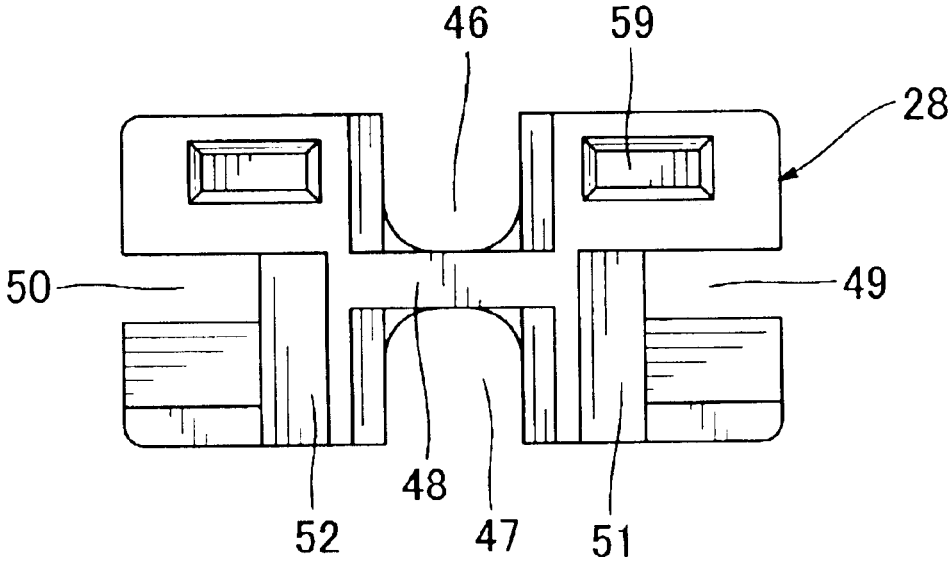
FIG. 10 is a rear view of the guide plate in the embodiment of the present invention.
Figure 11:
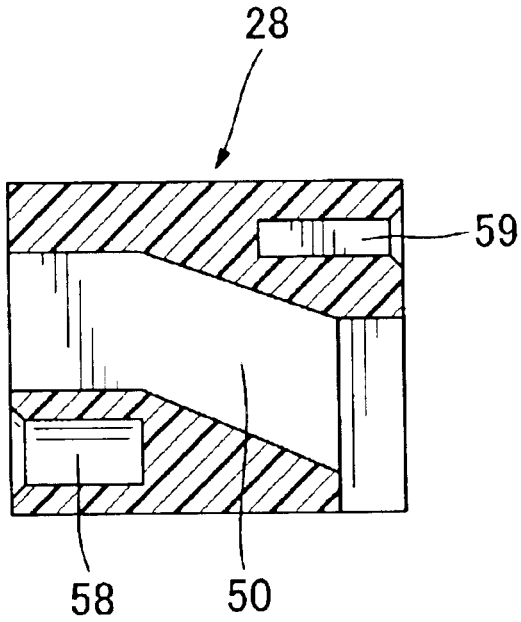
FIG. 11 is a cross-sectional view at C—C in FIG. 8.
Figure 12:
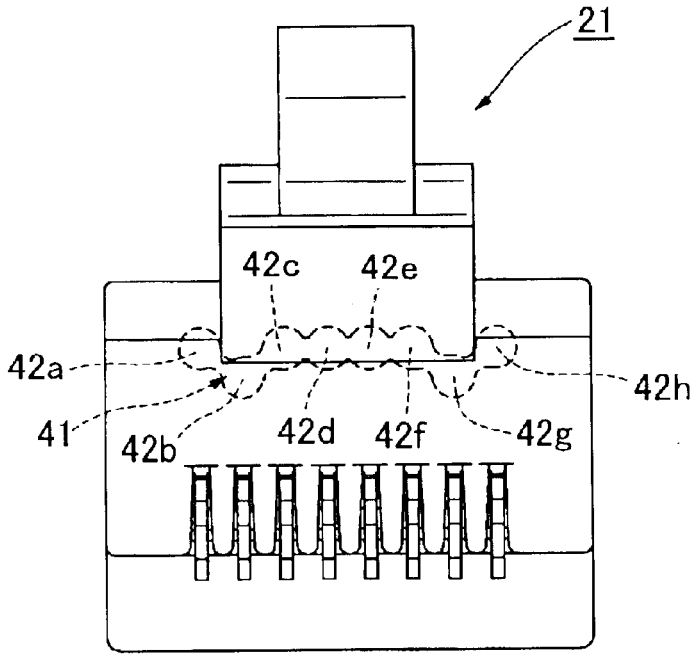
FIG. 12 is a front view of another arrangement of the cylindrical holes of the alignment member in the embodiment of the present invention.
Figure 13:
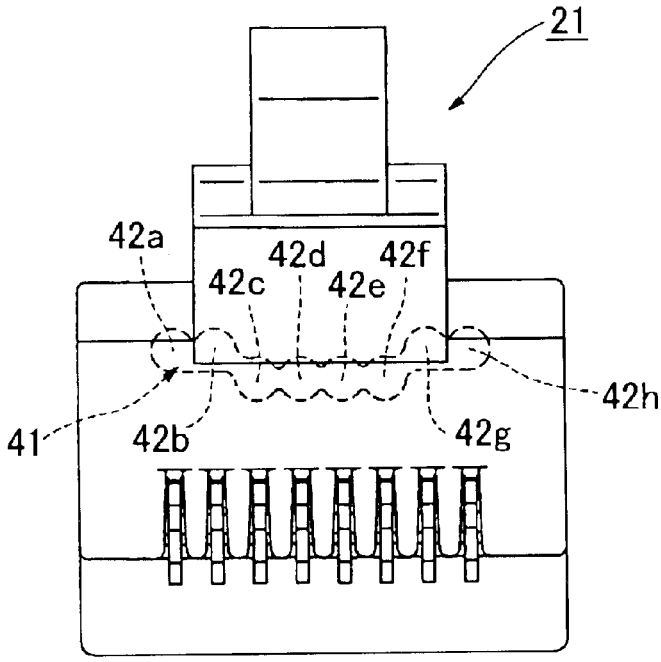
FIG. 13 is a front view of another arrangement of the cylindrical holes of the alignment member in the embodiment of the present invention.
Figure 14:
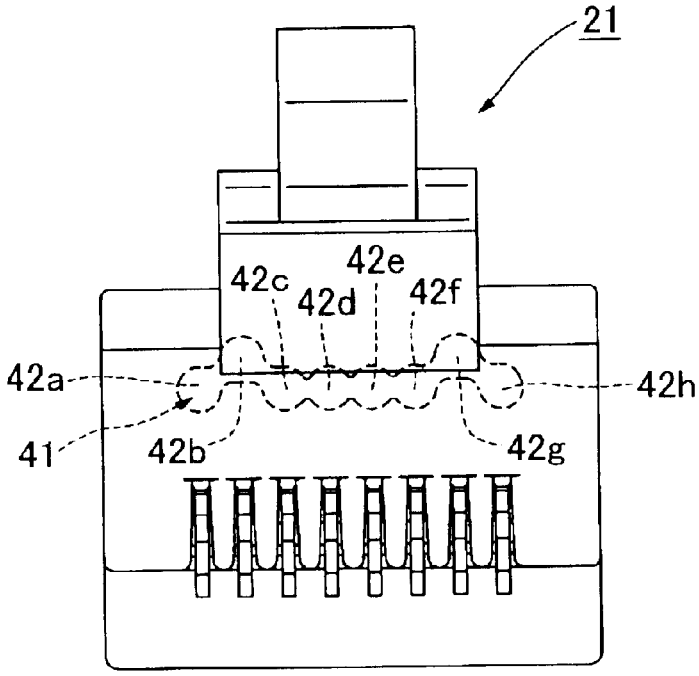
FIG. 14 is a front view of another arrangement of the cylindrical holes of the alignment member in the embodiment of the present invention.
Figure 15:
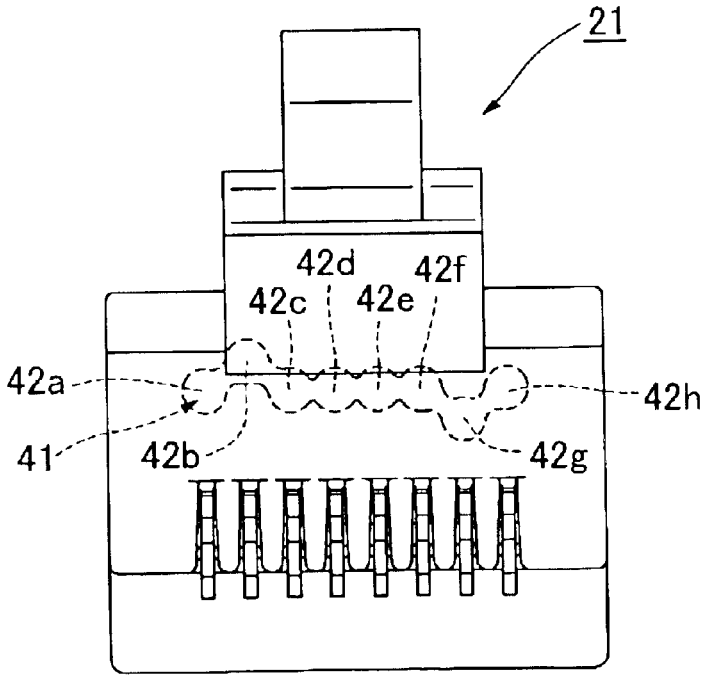
FIG. 15 is a front view of another arrangement of the cylindrical holes of the alignment member in the embodiment of the present invention.
Figure 16:
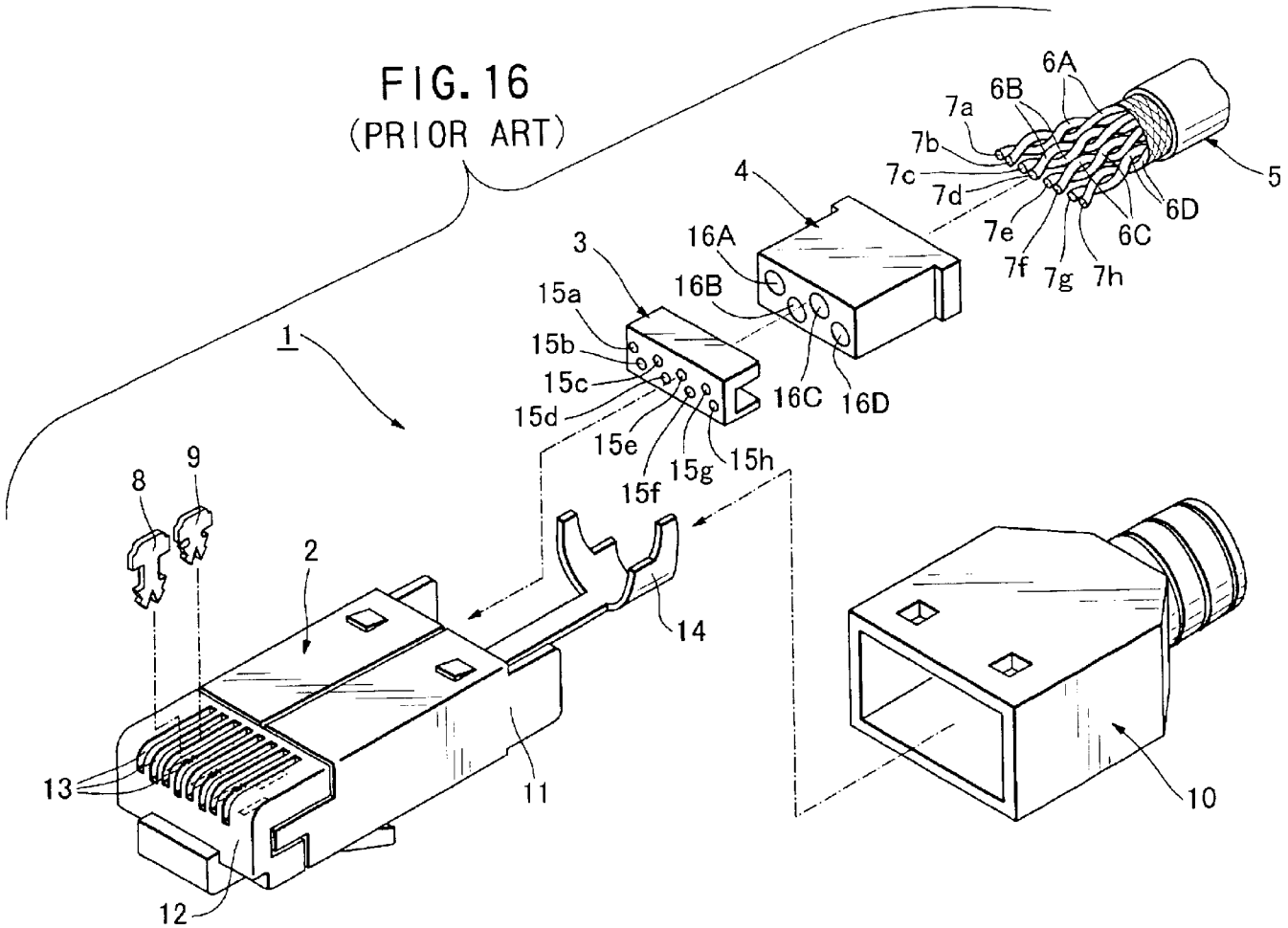
FIG. 16 (PRIOR ART)
FIG. 16 is an oblique perspective view of an example of the prior art.
Figure 17:
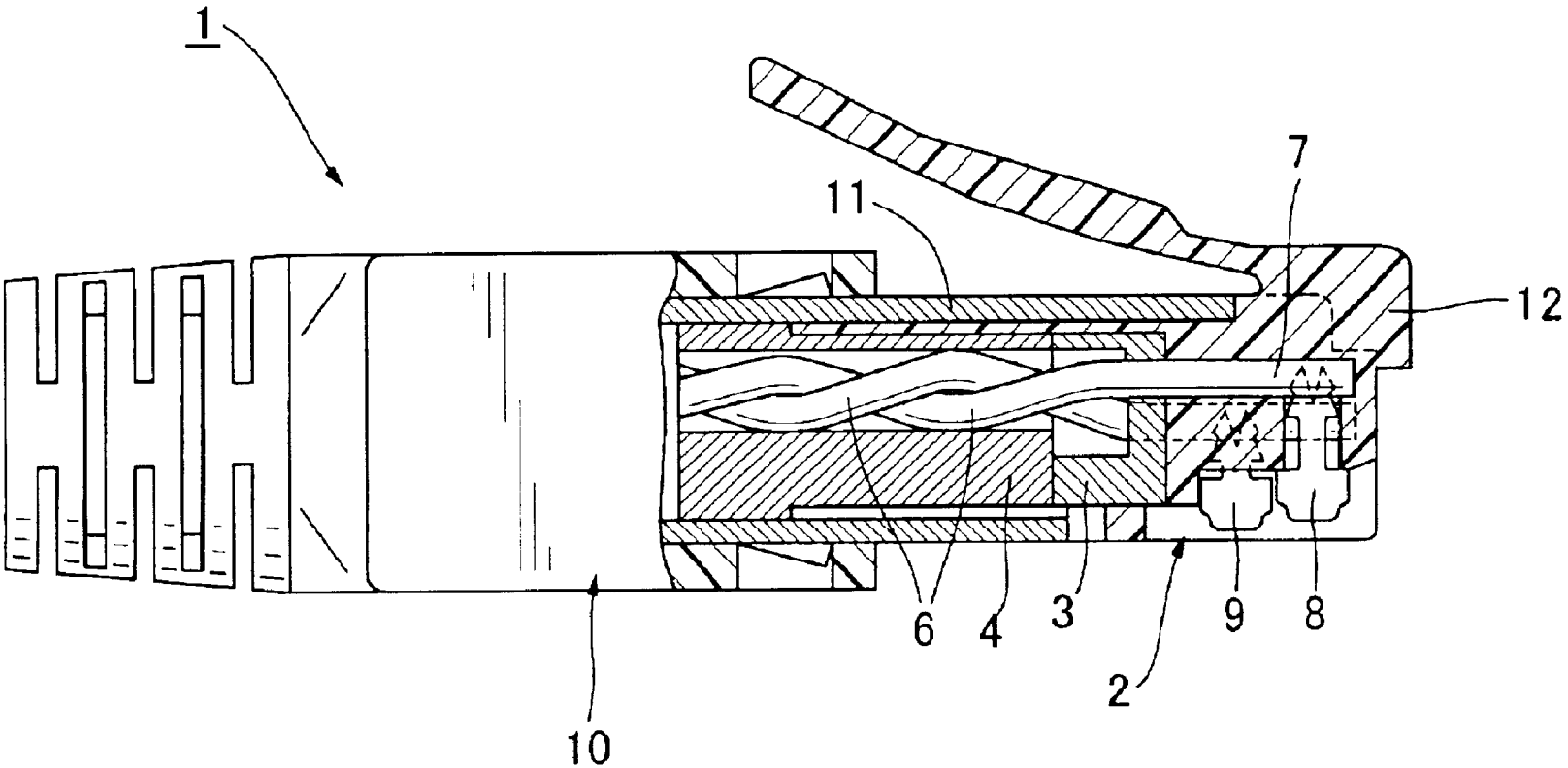
FIG. 17 (PRIOR ART)
FIG. 17 is a broken-out cross-sectional view of the example of the prior art.

FIG. 8 is a front view of the guide plate 28 viewed from the base end side, FIG. 9 is a plan view thereof, FIG. 10 is a rear view thereof, and FIG. 11 is a sectional view thereof at C—C in FIG. 8. As clearly shown in FIGS. 8 to 11, the guide plate 28 has an upper groove 46 and a lower groove 47 formed on the top surface and the bottom surface, respectively, and the upper groove 46 and the lower groove 47 are separated from each other by a horizontal partition 48. Further, the guide plate 28 also has a right groove 49 and a left groove 50 on the right surface and the left surface, respectively. The right groove 49 is separated from the upper and lower grooves 46 and 47 by a right vertical partition 51, and the left groove 50 is separated from the upper and lower grooves 46 and 47 by a left vertical partition 52. That is, the upper groove 46, lower groove 47, right groove 49 and left groove 50 are separated from one another by the horizontal partition 48 and the right and left vertical partitions 51 and 52. The distance between the right and left grooves 49 and 50 is larger than that between the upper and lower grooves 46 and 47. Further, an upper edge 53 and a lower edge 54 (refer to FIG. 2) on the front end side of the horizontal partition 48 and outer edges 55 and 56 (refer to FIG. 2) on the front end side of the right and left vertical partitions 51 and 52 are formed such that they press the twisted pair wires 22A, 22B, 22C and 22D against the internal surfaces of the insulation housing 26 at a position closest possible to the alignment member 27 so as to fully expand them in an internal space 57 of the insulation housing 26. In addition, by changing the thicknesses of the horizontal partition 48 and the vertical partitions 51 and 52, the degree of pressing the twisted pair wires 22A, 22B, 22C and 22D against the internal surfaces of the insulation housing 26 can be adjusted. Further, the guide plate 28 has cylindrical grooves 58 formed on both sides of a lower portion on the front end side and prismatic grooves 59 formed on both sides of an upper portion on the base end side. Although the right and left grooves 49 and 50 in this example are formed such that they are inclined upward toward the front end side, they may be formed horizontally.

The clamp 29 comprises a horseshoe-shaped housing fixing portion 60 and an U-shaped cable fixing portion 61 which is provided on the base end side of the housing fixing portion 60. The housing fixing portion 60 has engagement projections 62 which can be engaged in the prismatic grooves 59 protruding toward the base end direction and also has locking concave portions 63 in which the locking projections 36 can be locked formed on the bottom surface.

Next, the procedure of assembly of the modular plug 21 will be described.

Firstly, the engagement projections 62 are engaged into the prismatic grooves 59 so as to connect the clamp 29 to the guide plate 28, thereby clamping and holding the cable 23 by the cable fixing portion 61 of the clamp 29. Then, the four pairs of twisted pair wires 22A, 22B, 22C and 22D are separated from one another, without being untwisted, by the left and right grooves 50 and 49 and upper and lower grooves 46 and 47 of the guide plate 28 and held in the widened portion 45 of the alignment member 27, and untwisted tips of the wires, i.e., the eight electric wires 24*a*, 24*a*', 24*b*, 24*b*', 24*c*, 24*c*', 24*d* and 24*d*' are inserted and held in the corresponding cylindrical holes 42*a*, 42*b*, 42*c*, 42*d*, 42*e*, 42*f*, 42*g* and 42*h* of the through hole 41 of the alignment member 27. As described above, the twisted pair wires 22A, 22B, 22C and 22D are held in the widened portion 45 to a point very close to the through hole 41 without being untwisted. As a result, near end crosstalk can be reduced.

With the twisted pair wires 22A, 22B, 22C and 22D held in the twisted pair wire holding portion 39 of the alignment member 27, the cylindrical grooves 58 of the guide plate 28 are fitted over the positioning projections 40 of the alignment member 27 from the base end side so as to connect the guide plate 28 to the alignment member 27. Then, when the four pairs of twisted pair wires 22A, 22B, 22C and 22D are fitted into the right groove 49, the upper groove 46, the lower groove 47 and the left groove 50, respectively, the twisted pair wires 22A, 22B, 22C and 22D are pressed against the internal surfaces of the insulation housing 26 by the outer edge 55, the upper edge 53, the lower edge 54 and the outer edge 56, respectively, at a position closest possible to the alignment member 27 so as to be fully expanded in the space 57. Thereby, the twisted pair wires 22A, 22B, 22C and 22D are separated from one another at certain distances by the horizontal partition 48 and the right and left vertical partitions 51 and 52, so that the attenuation of near end crosstalk can be kept within a predetermined range.

Thereafter, together with the clamp 29, the alignment member 27 and the guide plate 28 which hold the four pairs of twisted pair wires 22A, 22B, 22C and 22D as described above are inserted into the fitting concave portion 25 of the insulation housing 26 and fixed in the insulation housing 26 by locking the locking projections 36 in the locking concave portions 63. Then, the terminals 30 and 31 are inserted into the slits 33 from the bottom and connected to the electric wires 24*a*, 24*a*', 24*b*, 24*b*', 24*c*, 24*c*', 24*d* and 24*d*'. At that time, the long terminals 30 are used for the electric wires 24*b*, 24*c*, 24*c*' and 24*b*' which are held in the upper cylindrical holes 42*c*, 42*d*, 42*e* and 42*f*, while the short terminals 31 are used for the electric wires 24*a*, 24*a*', 24*d* and 24*d*' which are held in the lower cylindrical holes 42*a*, 42*b*, 42*g* and 42*h*.

The position of the cylindrical holes 42*a*, 42*b*, 42*c*, 42*d*, 42*e*, 42*f*, 42*g* and 42*h* is not limited to that described above and may be changed as required. For example, as shown in FIGS. 12 to 15, they may be arranged such that the cylindrical holes 42*a*, 42*c*, 42*d*, 42*e*, 42*f* and 42*h* are placed at the upper level and the cylindrical holes 42*b* and 42*g* are placed at the lower level (refer to FIG. 12), that the cylindrical holes 42*a*, 42*b*, 42*g* and 42*h* are placed at the upper level and the cylindrical holes 42*c*, 42*d*, 42*e* and 42*f* are placed at the lower level (refer to FIG. 13), that the cylindrical holes 42*b* and 42*g* are placed at the upper level and the cylindrical holes 42*a*, 42*c*, 42*d*, 42*e*, 42*f* and 42*h* are placed at the lower level (refer to FIG. 14), or that the cylindrical hole 42*b* is placed at the upper level, the cylindrical holes 42*a*, 42*c*, 42*d*, 42*e*, 42*f* and 42*h* are placed at the middle level and the cylindrical hole 42*g* is placed at the lower level (refer to FIG. 15). Further, when the position of the cylindrical holes is changed as described above, a through hole corresponding to the position of the cylindrical holes is formed in the alignment member 27.

Further, in the above description, the case where the cable 23 comprising the four pairs of twisted pair wires 22A, 22B, 22C and 22D is connected has been described. However, it is needless to say that the present invention can also be practiced in a case where two, three or five or more pairs of twisted pair wires are connected.

As described above, according to the present invention, twisted pair wires can be separated from one another by a guide plate and held between the internal surfaces of a housing and the guide plate, and without being untwisted, the twisted pair wires can be held to a point very close to where electric wires are held. As a result, near end crosstalk can be reduced securely, and an attenuation thereof can be kept within a predetermined range.

What is claimed is:

1. A modular plug which is fitted in a modular jack so as to connect twisted pair wires, the plug comprising:

a housing having internal surfaces, a guide plate which is fitted in said housing so as to separate said twisted pair wires from one another, and terminals which are connected to electric wires untwisted from the tips of said twisted pair wires, the guide plate having a top surface, a bottom surface, a right surface and a left surface, a horizontal partition, a right vertical partition and a left vertical partition, an upper groove formed on said top surface of said guide plate, a lower groove formed on said bottom surface of said guide plate at a first distance from said upper groove, said lower groove being separated from said upper groove by said horizontal partition, a right groove formed on said right surface of said guide plate, said right groove being separated from said upper and lower grooves by said right vertical partition, and a left groove formed on said left surface of said guide plate at a second distance from said right groove, said second distance being greater than said firs distance, and said left groove being separated from said upper and lower grooves by said left vertical partition;

wherein the separated twisted pair wires are held between said internal surfaces of housing and said guide plate.

2. The plug of claim 1, wherein said partitions are formed such that they expand said twisted pair wires toward said internal surfaces of said housing.

3. The plug of claim 2, wherein said partitions are formed such that they expand the twisted pair wires toward said internal surfaces of said housing by front end side edges thereof.

4. A modular plug which is fitted in a modular jack so as to connect twisted pair wires, the plug comprising:

a housing, an alignment member which is fitted in said housing and has a through hole, said through hole including a base end side, for holding in alignment eight electric wires untwisted from the tips of first to fourth twisted pair wires at multiple upper and lower levels, said alignment member including front end, an inclined plane, an electric wire holding portion having a base end side, guide portions which protrude from said electric wire holding portion toward said front end of the alignment member, and a twisted pair wire holding portion formed on said base end side of said electric wire holding portion; and eight terminals which are connected to the electric wires untwisted from the tips of said first to fourth twisted pair wires, wherein said through hole is formed such that said first twisted pair wire and adjacent electric wires of said second twisted pair wire are placed at different levels, the electric wires of said third twisted pair wire and said fourth twisted pair wire are placed at different levels, and the electric wires of said second and third twisted pair wires are placed side by side at the same level, and said base end side of said through hole is widened along a perimeter of said through hole by said inclined plane of said alignment member, thereby forming a widened portion in said twisted pair wire holding portion.

5. The plug of claim 4, wherein said through hole includes a widened portion on said base end side of said through hole capable of holding said twisted pair wires at a position proximate to said through hole without untwisting said twisted pair wires.

6. A modular plug which is fitted in a modular jack so as to connect twisted pair wires, the plug comprising:

a housing having internal surfaces, an alignment member which is fitted in said housing and has a base end side, and a through hole for holding in alignment eight electric wires untwisted from the tips of first to fourth twisted pair wires at multiple upper and lower levels, a guide plate which is fitted to said base end side of said alignment member in said housing so as to separate said first to fourth twisted pair wires from one another, and eight terminals which are connected to said eight electric wires, wherein said through hole is formed such that said first twisted pair wire and said second twisted pair wire are placed at different levels, the electric wires of said third twisted pair wire and the electric wires of said fourth twisted pair wire are placed at different levels, and the electric wires of said second and third twisted pair wires are placed side by side at the same level, and said first to fourth twisted pair wires are held between said internal surfaces of said housing and said guide plate.

7. The plug of claim 6, wherein said guide plate has grooves formed on each of top, bottom, left and right surfaces of said guide plate, and said grooves are separated from one another by partitions.

8. The plug of claim 7, wherein said positions are formed such that they expand said twisted pair wires toward said internal surfaces of said housing.

9. The plug of claim 8, wherein said partitions are formed such that they expand said twisted pair wires toward said internal surfaces of said housing by front end side edges thereof.

10. The plug of claim 6, wherein said through hole includes a widened portion on said base end side of said through hole capable of holding said twisted pair wires at a position proximate to said through hole without untwisting said twisted pair wires.

11. The plug of claim 8, wherein said through hole includes a widened portion on said base end side of said through hole capable of holding said twisted pair wires at a position proximate to said through hole without untwisting said twisted pair wires.

12. The plug of claim 8, said through hole includes a widened portion on said base end side of said through hole capable of holding said twisted pair wires at a position proximate to said through hole without untwisting said twisted pair wires.

13. The plug of claim 9, wherein said through hole includes a widened portion on said base end side of said through hole capable of holding said twisted pair wires at a position proximate to said through hole without untwisting said twisted pair wires.

14. A modular plug which is fitted in a modular jack so as to connect twisted pair wires, the plug comprising:

a housing having internal surfaces, a guide plate which is fitted in said housing so as to separate said twisted pair wires from one another, and terminals which are connected to electric wires untwisted from the tips from said twisted pair wires, wherein said twisted pair wires are held between said internal surfaces of said housing and said guide plate, wherein said guide plate has grooves separated from one another by partitions, and wherein said partitions have edges so formed as to expand said twisted pair wires toward said internal surfaces of said housing.

15. A modular plug which is fitted in a modular jack so as to connect twisted pair wires, the plug comprising:

a housing, an alignment member which is fitted in said housing and has a through hole, for holding in alignment eight electric wires untwisted from the tips of first to fourth twisted pair wires at multiple upper and lower levels, said through hole having a base end side and widened portion on said base end side capable of holding said twisted pair wires to a point as close as possible to said through hole without untwisting said twisted pair wires; and eight terminals which are connected to the electric wires untwisted from the tips of said twisted pair wires, wherein said through hole is formed such that said first twisted pair wire and adjacent electric wires of said second twisted pair wire are placed at different levels, the electric wires of said third twisted pair wire and said fourth twisted pair wire are placed at different levels, and the electric wires of said second and third twisted pair wires are placed side by side at the same level.

* * * * *